US006229491B1

(12) United States Patent
Bolden et al.

(10) Patent No.: US 6,229,491 B1
(45) Date of Patent: May 8, 2001

(54) COMPACT YAGI ANTENNA ARRAY FOR AIRCRAFT

(75) Inventors: George H. Bolden, Bronx; James A. Casey, Smithtown, both of NY (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 08/238,435

(22) Filed: May 5, 1994

Related U.S. Application Data

(63) Continuation-in-part of application No. 07/937,289, filed on Aug. 31, 1992, now abandoned.

(51) Int. Cl.[7] ..... H01Q 1/28; H01Q 19/30

(52) U.S. Cl. ..... 343/708; 343/789; 343/819

(58) Field of Search ..... 343/705, 708, 343/789, 833, 834, 821, 872, 878; H01Q 19/10, 19/30, 9/16, 9/26, 1/42, 1/28

(56) References Cited

U.S. PATENT DOCUMENTS 4,336,543 * 6/1982 Ganz et al. ..... 343/705
4,749,997 * 6/1988 Ganonico ..... 343/705
5,151,707 * 9/1992 Kumpfbeck et al. ..... 343/705

* cited by examiner

*Primary Examiner*—Michael C. Wimer
(74) *Attorney, Agent, or Firm*—Terry J. Anderson; Karl J. Hoch, Jr.

(57) ABSTRACT

A Yagi antenna array is specifically designed for insertion in a thin wing leading edge radome. Tubular elements for driver, director components are inserted within the structural web of the radome and critical dimensions of antenna components, relative to wavelength, help achieve superior performance in the compact package.

1 Claim, 2 Drawing Sheets

COMPACT YAGI ANTENNA ARRAY FOR AIRCRAFT

CROSS-REFERENCE TO RELATED APPLICATIONS

This application is a Continuation-In-Part of application Ser. No. 07/937,289 filed Aug. 31, 1992, now abandoned, in the name of George H. Bolden and James A. Casey, the entire contents of said prior application being expressly incorporated herein by reference.

FIELD OF THE INVENTION

The present invention relates to an integral Yagi antenna array particularly suited for installation in aircraft wings.

BACKGROUND OF THE INVENTION

The present invention is an improvement to U.S. Pat. No. 4,514,734 issued to the assignee of the present application. The antenna system disclosed in the patent provides a scanning antenna array system having low sidelobes in both the electronic and mechanical scanning modes. Further, the antenna array system set forth therein exhibited low mutual electromagnetic coupling between individual antenna elements. That system further exhibits smooth antenna in-array element patterns, improved power transfer characteristics when electronically scanned, and relatively high and uniform gain over a finite bandwidth.

Yet another advantage of the prior art system was its suitability for aircraft use and scannability over a total angle of about 90° with excellent gain uniformity throughout the scanning range. The design was adapted to low profile configurations for installation in leading and trailing edge airfoils having reasonably large cross sections.

In particular, the structure of the patented antenna comprised vertically stacked arrays, each having a plurality of mutually parallel-spaced directors physically mounted to the internal surface of the wings. As the wings of high-performance aircraft become thinner, with the result that less room is available in the leading edge, such a physical assembly of antenna components becomes impossible. Accordingly, a new type of Yagi antenna array assembly that is small with respect to wavelength is necessary. The challenge then becomes designing the antenna to be efficient and still practical for such aircraft.

BRIEF DESCRIPTION OF THE PRESENT INVENTION

The present invention is particularly suited for installation within leading edge radomes of thin wing aircraft. In lieu of separately mounting the elements of each antenna, the present invention incorporates an integral antenna array. One wall of a wing box within the aircraft serves as a common ground plane reflector for the entire array. The individual elements of each antenna are fabricated from tubular members supported within a structural web, fabricated from a honeycomb material which conforms to the interior of a leading edge radome. This integral compact design allows an antenna array to be installed within a thin, low profile leading edge of a high-performance aircraft.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
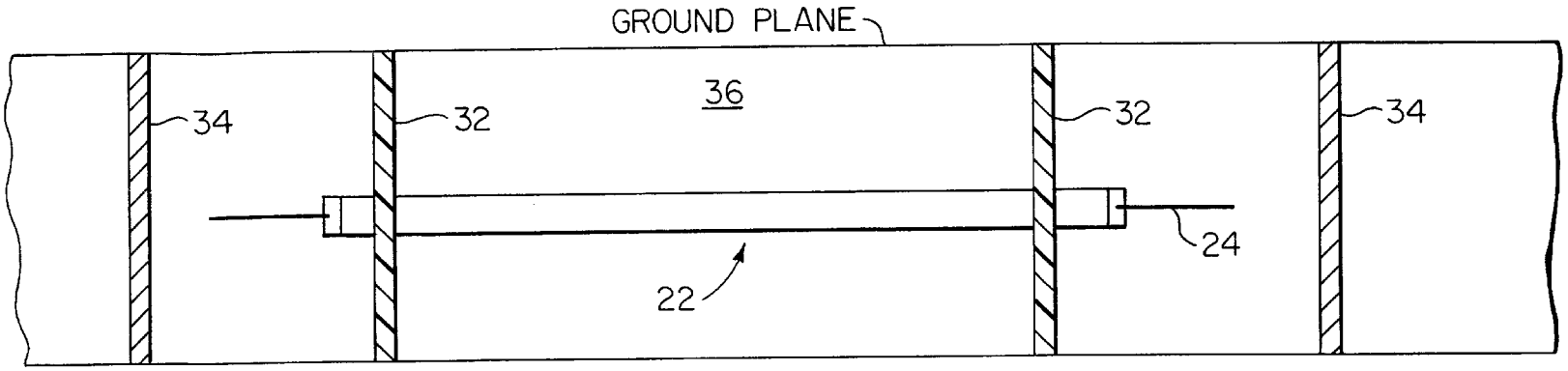
FIG. 1 is a cut away view of an aircraft radome illustrating a front elevational view of a compact Yagi antenna element for a scannable array.
Figure 2:
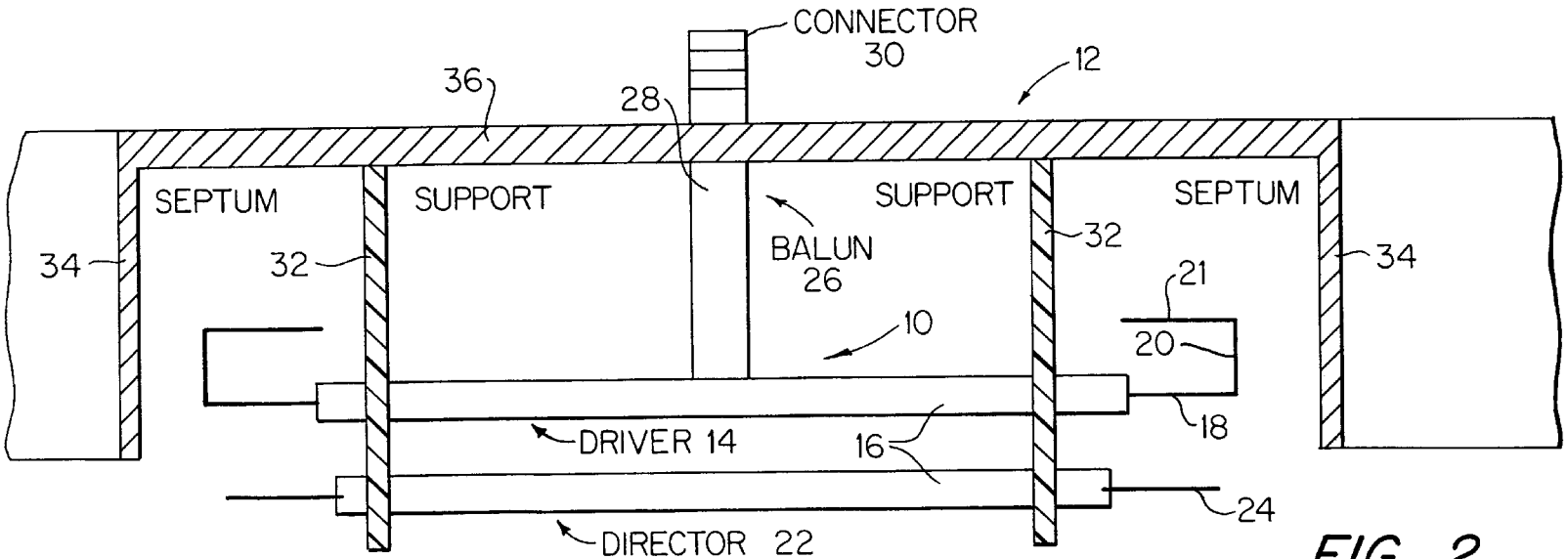
FIG. 2 is a top cut away view of FIG. 1.

FIGS. 1 and 2 illustrates a compact Yagi antenna element for a scannable array in accordance with the present invention. A plurality of such antennas may be mounted in adjacent co-planar relationship. Typically, the antenna element, generally indicated by reference numeral 10, may be located within the radome 12 of the leading edge of an aircraft wing. Of course, it is to be understood that the invention may be installed in the trailing edge of an aircraft wing where sufficient space exists.

As in the case of the previously mentioned patent, each antenna element 10 includes a tubular driver 14 jacketed in a plastic sleeve 16. A copper wire 18 passes through the sleeve and terminates at either end of the driver in a hook back section which is generally L-shaped, and includes a bight 20 and final termination segment 21 that is parallel with the longitudinal axis of the driver 14.

In parallel spaced relationship to driver 14 is a director 22 which also has an insulative plastic jacket 16 and the copper wire 24 passing therethrough. However, the director does not include any hook back sections as did the driver 14.

A balun 26 includes a similar jacket 28, and extends perpendicularly to the driver 14 for passage through a ground plane panel 36 for termination in an electrical connector 30.

Two parallel spaced insulative supports 32 extend perpendicularly from the ground plane 36 and receive the driver 14 and director 22 therebetween. These supports maintain the driver and director in parallel spaced relationship.

Parallel spaced septums 34 are located outwardly from respective supports 32, the septums being metal and connected at rearward edges to the ground plane 36. As shown in FIG. 1, the height of each septum is the same as the supports. The ground plane is fabricated from metal as well.

Figure 3:
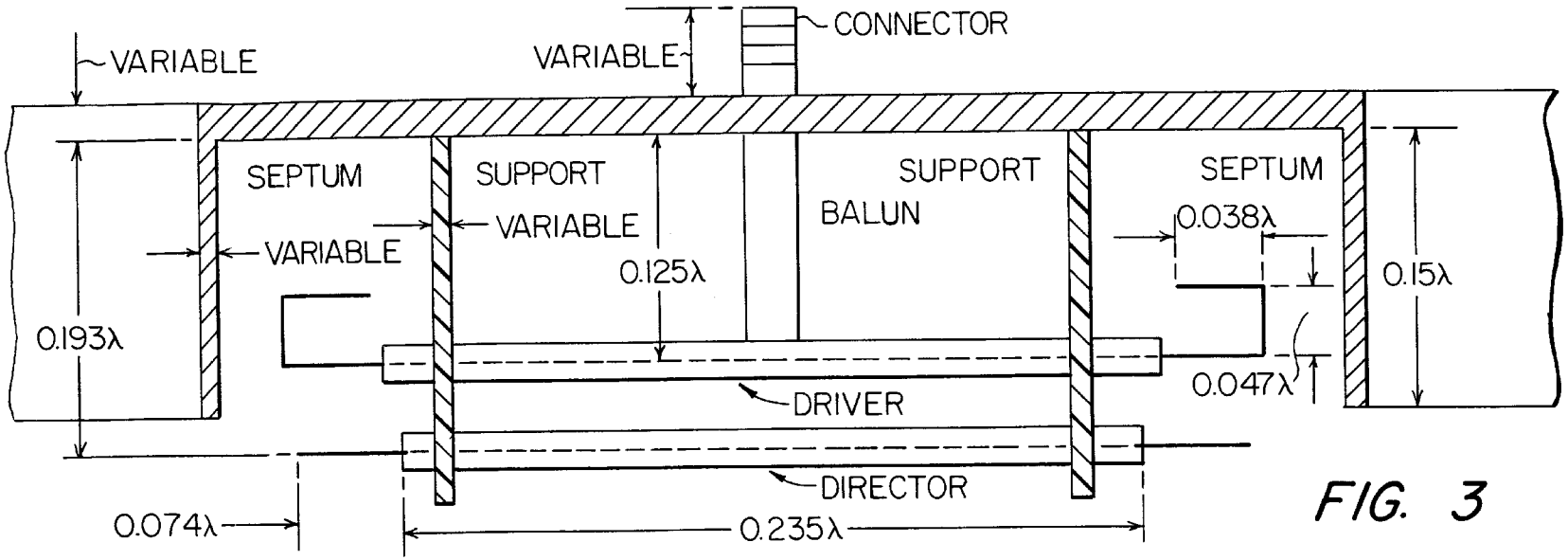
FIG. 3 is a view similar to FIG. 2 indicating critical dimensions, relative to wavelength, for the antenna element.
Figure 4:
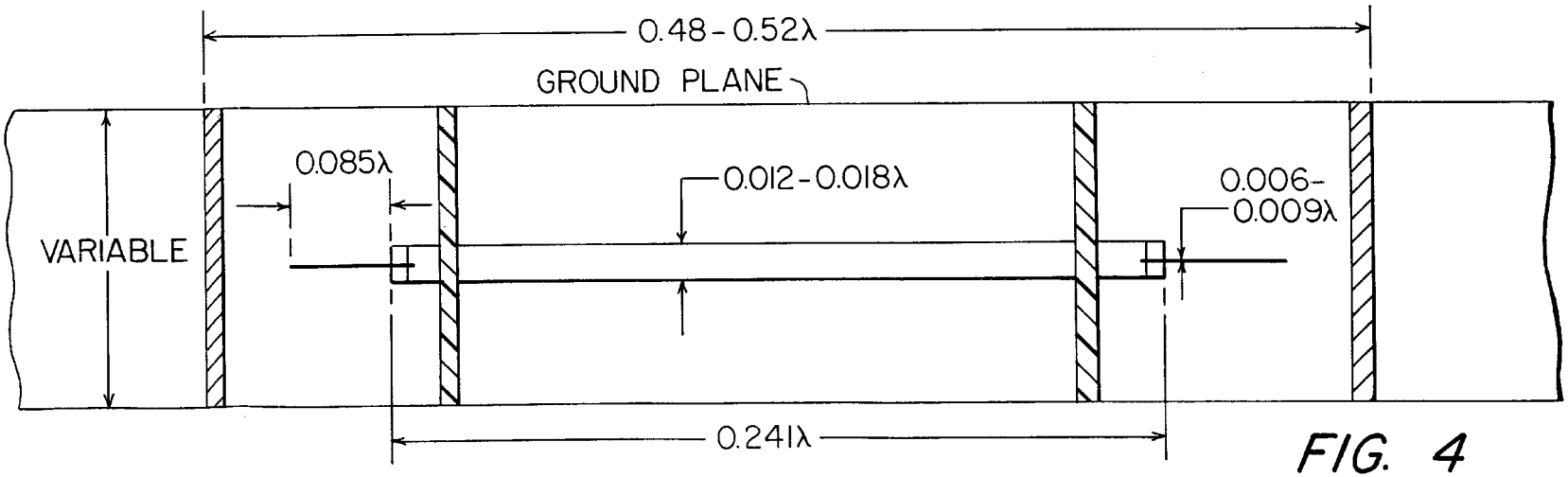
FIG. 4 is a view similar to that of FIG. 1 illustrating critical dimensions for the antenna element.

The superior performance gained by the present invention rests in the critical dimensional relationships of the various parts of each antenna element. These dimensions, relative to operational wavelength, are illustrated in FIGS. 3 and 4.

Typically, the balun-driver of each antenna is located within the core of honeycomb in a radome. From the above description of the invention, it will be appreciated that a compact and cost-reduced structure becomes available for thin wing, high-performance aircraft.

The antenna element shown in the figures may be repeated to form an array. In this case, the directors may be formed from a single elongated length of jacketed conductor, with the conductors being exposed at regular intervals to form terminations for each antenna element director.

It should be understood that the invention is not limited to the exact details of construction shown and described herein for obvious modifications will occur to persons skilled in the art.

What is claimed is:

1. A Yagi antenna element having an operational wavelength λ and enclosed within an aircraft wing box, comprising:

an internal wall of the wall box serving as a ground plane fabricated from a conductor;

a driver located in parallel spaced relation with the ground plane and supported between two parallel spaced insulative supports;

a director located in parallel spaced relation with both the ground plane and the driver, the director supported between the two parallel spaced insulative supports, the director having straight outward terminals;

the driver having an outward L-shaped hook back conductor terminal at each end defined by an outward section parallel to the ground plane and extending back toward a balun, and an inner section perpendicular to the length of the driver and connected between the driver and the outward section;

the balun connected at a first end to the driver, and a second end thereof passing through the ground plane wall for termination in a connector; and parallel spaced metal septums located equidistantly from corresponding insulative supports and parallel to the supports;

the distance between a forward surface of the ground plane wall and an axis of the director being 0.193λ;

the distance between the forward surface of the ground plane wall and an axis of the driver being 0.125λ;

the distance between the forward surface of the ground plane wall and a front edge of each septum being 0.15λ;

the length of the inner section of the hook back conductor being 0.047λ;

the length of the outward section of the hook back conductor being 0.038λ;

the length of a jacketed portion of the director being 0.235λ;

the length of the terminals of the director, measured from the end of the jacketed portion to the end of the director, being 0.074λ;

the length of the ground plane wall is 0.48–0.52λ;

the length of a jacketed section of the driver is 0.241λ;

the length of the terminals of the drivers being 0.085λ;

the thickness of a conductor of the director and of the driver is 0.006–0.0009λ; and the thickness of jacketed sections of the director and the driver is 0.012–0.018λ.

* * * * *